US006430779B1

(12) United States Patent
Goldsmith et al.

(10) Patent No.: US 6,430,779 B1
(45) Date of Patent: Aug. 13, 2002

(54) MOUNTING APPARATUS FOR CONCEALED HINGE OF OPERABLE WALL

(75) Inventors: Thomas L. Goldsmith, Earlville, IA (US); Reanus Jones; Jerald A. McRoberts, both of New Castle, IN (US); Shannon B. Richardson, Earlville, IA (US)

(73) Assignee: Modernfold, Inc., New Castle, IN (US)

( * ) Notice: Subject to any disclaimer, the term of this patent is extended or adjusted under 35 U.S.C. 154(b) by 0 days.

(21) Appl. No.: 09/818,212

(22) Filed: Mar. 27, 2001

Related U.S. Application Data

(60) Provisional application No. 60/193,890, filed on Mar. 31, 2000.

(51) Int. Cl.[7] ..... E05D 5/00

(52) U.S. Cl. ..... 16/382; 16/368; 16/357; 49/398; 160/229.1

(58) Field of Search ..... 16/382, 366, 368, 16/369, 357; 160/229.1, 199, 135, 220, 218, 236, 251, 231.2; 49/398, 399, 400

(56) References Cited

U.S. PATENT DOCUMENTS

| | | | | | |
|---|---|---|---|---|---|
| 1,094,010 | A | * | 4/1914 | Soss | 126/194 |
| 1,114,026 | A | * | 10/1914 | Parsons | 16/270 |
| 1,582,701 | A | * | 4/1926 | Soss | 16/389 |
| 1,648,781 | A | * | 11/1927 | Pepin | 16/355 |
| 2,217,937 | A | * | 10/1940 | Anderson | 16/379 |
| 4,304,027 | A | * | 12/1981 | Di Fazio | 16/249 |
| 4,438,597 | A | * | 3/1984 | Maggart | 16/242 |
| 4,553,286 | A | * | 11/1985 | Schwarz, II | 16/222 |
| 4,825,509 | A | * | 5/1989 | Mitchell et al. | 16/254 |
| 5,075,928 | A | * | 12/1991 | Bobrowski | 16/273 |
| 5,347,686 | A | * | 9/1994 | Tyler et al. | 16/247 |
| 5,357,725 | A | * | 10/1994 | Ferry | 16/222 |

OTHER PUBLICATIONS

UIP, "Soss Invisible Hinges," Product Catalog, Universal Industrial Products Co., p. 12, (Mar. 26, 1999).

UIP, "Soss Invisible Hinges, Product Sheet: Soss Reinforcement For Steel Doors.," UIP, p. 1.

Holcomb & Hoke Mfg. Co., Inc., "FoldDoor: Custom–Line Folding Walls," Product Catalog, p. 6.

* cited by examiner

*Primary Examiner*—Chuck Y. Mah
(74) *Attorney, Agent, or Firm*—Baker & Daniels

(57) ABSTRACT

A mounting bracket for an invisible hinge of an operable wall includes upper and lower end portions for attachment of the bracket to the edge frame of the operable wall. The end portions include vertical slots to allow for vertical adjustment of the wall. Holes for locking screws are also provided the secure position of the wall after adjustment. The mounting bracket, includes a recessed portion to receive the main body of the invisible hinge. The bracket may also include an acoustic coating or an optional hinge encapsulating acoustic boot to provide improved sound barrier characteristics for the operable wall.

18 Claims, 11 Drawing Sheets

MOUNTING APPARATUS FOR CONCEALED HINGE OF OPERABLE WALL

CROSS-REFERENCE TO RELATED APPLICATION

This application claims the benefit under 35 U.S.C. §119(e) of co-pending U.S. Provisional Application No. 60/193,890, filed Mar. 31, 2000.

BACKGROUND OF THE INVENTION

The present invention pertains to operable walls movable to partition large rooms into smaller rooms, and, in particular, to mounting assemblies for hinges that connect together adjacent panels of an operable wall.

Operable walls or partitions, also known as moveable wall panel systems, find useful application in a variety of venues, such as classrooms, offices, convention facilities and hospitals. In these venues, the operable walls can be used to efficiently divide or compartmentalize interior space into a multitude of separate, smaller rooms. In particular, the operable wall panels are typically connected to trolleys that roll within an overhead track. Travel of the trolleys within the track allows the panels to be moved between a stacked arrangement in a storage location, and a wall-forming, extended arrangement in alignment with the overhead track.

Several shortcomings of both paired panel systems and continuously hinged panel systems of operable walls relate to the hinges typically utilized to connect adjacent panels. Butt hinges which are normally used each include a pair of base plates that are pivotably pinned together at a hinge knuckle. Although the base plates that are mounted to the facing ends of hingedly connected panels are concealed when the panels are disposed in a wall-forming arrangement, the hinge knuckle projects beyond the room-forming wall facade even when the wall is formed.

Due to the fact that frequently several hinges are used at each panel interconnection, the smooth appearance of the wall is noticeably interrupted by the presence of the hinge knuckles, which detracts from the overall aesthetics of the wall. Moreover, because the hinge knuckles project into the room formed by the operable wall, they can be a nuisance and danger to users of the wall.

To address this shortcoming, previous attempts have been made to utilize devices known as concealed or invisible hinges in operable walls. Invisible hinges include parts that mount directly to the end faces of the panels, but the hinges are designed such that no part of the hinge extends beyond the room-forming facades of the panels. These types of hinges are therefore generally invisible to persons on both sides of the wall when the hinged panels are arranged in an extended or wall-forming arrangement.

In the past, the mounting of invisible hinges to operable walls, such as walls having panels with metal frames, utilized brackets. One known bracket was structured to be mountable in the center of the panel edge. The bracket includes and with slots so as to be vertically adjustable, but included a laterally offset opening in which the hinge was mounted such that the hinge could be positioned near the face of the wall panel. While advantageous in that the invisible hinge was thereby mountable to the frame and its backing plate, this bracket was not without its limitations. In particular, the manner of mounting the hinge resulted in inferior sound barrier properties with respect to sounds traveling from one side of the extended wall to the other side. In addition, while designed to permit vertical adjustability that allowed adjacent panels to be lined up properly, the brackets were susceptible to loosening from the frame over time, which loosening could allow vertical shifting of the hinge relative to the panel. Since the wall facades often include special coverings which need to be closely lined up between adjacent panels to maintain a professional appearance, such shifting could compromise the aesthetics of the wall.

Thus, it would be desirable to overcome these and other shortcomings of the prior art.

SUMMARY OF THE INVENTION

The present invention provides a mounting bracket for an invisible hinge of an operable wall. The mounting bracket, especially in conjunction with an optional hinge encapsulating acoustic boot, provides improved sound barrier characteristics for the operable wall. The mounting bracket also allows for vertical adjustability during its installation, and further can be locked in place when properly installed.

The mounting bracket includes a pair of end portions slotted to allow for vertical adjustment of the bracket on the edge frame of an operable wall panel. The bracket further includes a recessed plate portion forming a receptacle for a main body portion of the invisible hinge. Each end portion further includes a hinge mounting section providing mounting holes for attachment of the invisible hinge flange to the bracket and to the edge frame of the operable wall. An offsetting span connects the hinge mounting section to the slotted portion. The offsetting span is angled so that the slotted portion is recessed relative to the hinge mounting section.

In a preferred embodiment, at least one end portions includes a locking hole configured to receive a fastener to lock the bracket in position on the edge frame. In a most preferred embodiment, the bracket is integrally formed of steel.

In another version of the invention, the center receptacle includes side panels forming a box.

In yet another embodiment, the bracket may be coated with a sound absorbing material such as latex, or may include a boot for the hinge main body. These features reduce sound transmission through the operable wall panels.

In still another embodiment, the mounting apparatus includes a pair of brackets vertically spaced on the edge frame of an operable wall. Each bracket includes a slotted base plate for adjusting the bracket. Each base plate also includes a threaded mounting block to which a flange of an invisible hinge attaches. At least one of the brackets also includes a locking hole for positioning of the bracket for attachment In this embodiment, the edge frame of the operable wall includes a cavity that receives the main body of the invisible hinge.

One advantage of the present invention is that it allows hinges used to connect together adjacent operable wall panels to be hidden when the operable wall is in a wall-forming arrangement, and therefore the hinges do not detract from the aesthetics of the room.

Another advantage of the present invention is that an invisible hinge can be mounted to an operable wall in a manner which does not compromise the acoustical or sound barrier properties of the operable wall.

Another advantage of the present invention is that a mounting bracket may be provided with a sound sealing member that is interposed between the bracket and the invisible hinge to provide improved sound barrier properties.

Still another advantage of the present invention is that a mounting bracket may be provided which is installable at various vertical locations along the height of the panel, thereby facilitating proper installation of the hinge, and at a desired vertical location the bracket can be locked in placed by the use of an additional locking member that engages the bracket.

BRIEF DESCRIPTION OF THE DRAWINGS

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
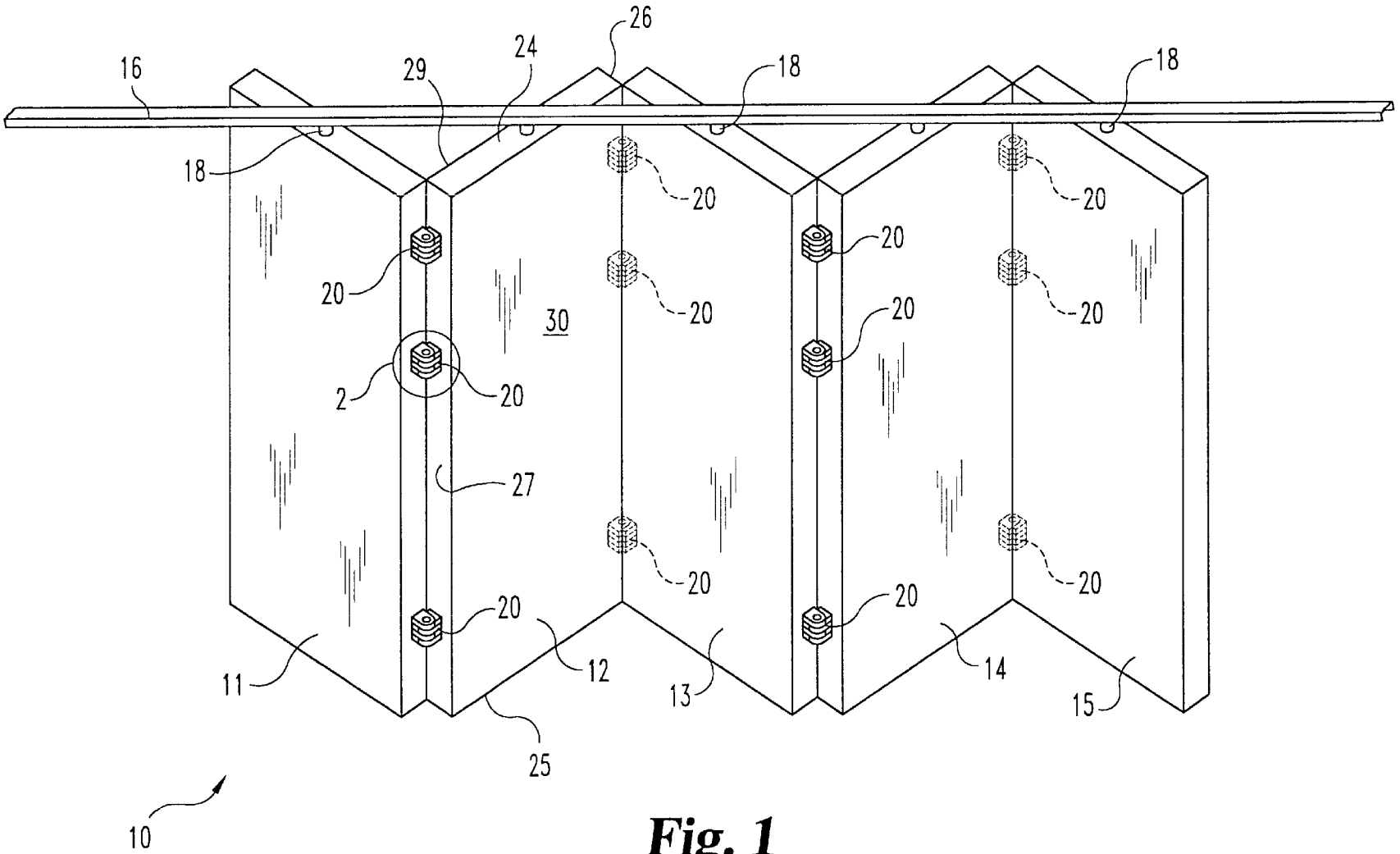
FIG. 1 is a diagrammatic perspective view of one embodiment of an operable wall equipped with concealed hinges, wherein the wall is shown being moved along a track between a fully stacked arrangement and an extended, wall-forming arrangement.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

The embodiments disclosed below are not intended to be exhaustive or limit the invention to the precise forms disclosed in the following detailed description. Rather, the embodiments are chosen and described so that others skilled in the art may better utilize the teachings of the invention.

Referring now to FIG. 1, there is diagrammatically shown a movable wall, generally designated 10, equipped with invisible hinges disposed with the mounting apparatuses of the present invention. The movable wall includes operable partitions or wall panels 11, 12, 13, 14 and 15 suspended from a track 16 by trolleys 18. The term trolley is used generally herein and is intended to encompass devices, including wheeled carriages and carriers, of all types that are operably connected to and movable along the track.

As referenced with respect to panel 12, each of panels 11–15 generally includes a top edge 24, a bottom edge 25, a vertical leading edge 26, and a vertical trailing edge 27, with leading and trailing used in reference to the relative position of various components which occurs when the panels are being moved from a stacked position to an extended position. Each of the panels 10–14 also includes side facades 29 and 30 that, when the operable wall is fully extended in a wall-forming arrangement, are aligned to form exposed wall surfaces in the room areas separated by the operable wall.

Each of the wall panels 11–15 is linked to the adjacent panels by multiple invisible hinges 20 arranged along the panel height at the facing edges of the panels. Track 16 is mountable in the ceiling of a room to be compartmentalized, and panels 11–15 may be moved along the track, either manually or by a known drive system, in wall stacking and wall extending directions. Except as otherwise described herein, the actual wall panels may be of any conventional design. Furthermore, although shown as being employed with a continuously hinged panel system, the invisible hinge mounting apparatuses described herein may be employed with different panel systems, including paired panel systems, and with different or non-straight track layouts. The inventive mounting apparatuses may also be employed with pass doors, pocket doors, and closure jambs within operable walls.

Figure 2A:
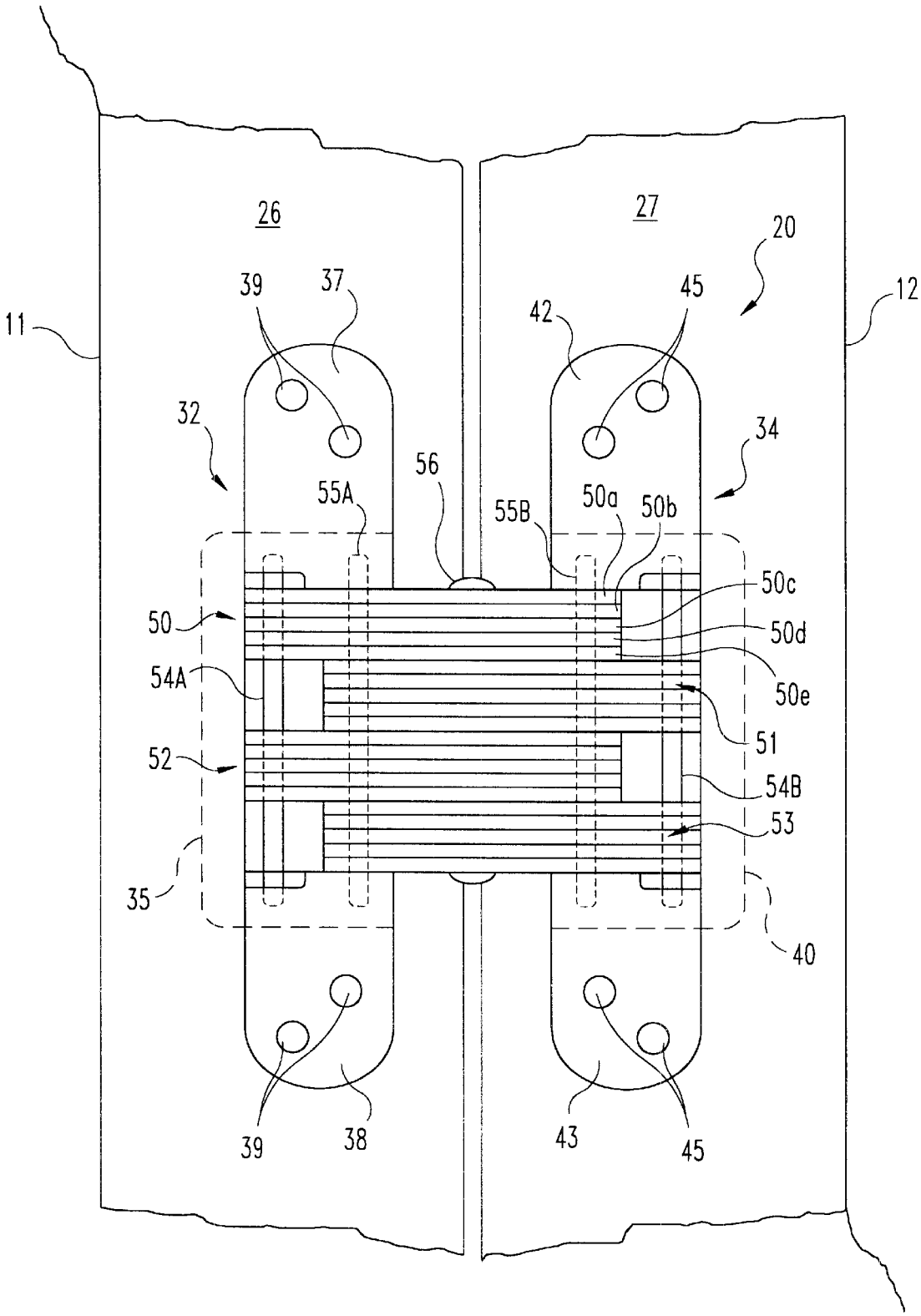
FIG. 2A is an enlarged view further illustrating one of the invisible hinges used to interconnect adjacent panels.

Referring now to FIG. 2A, there is shown an enlarged view of the encircled area referenced at 2 in FIG. 1 in which is shown one of the invisiblehinges 20 used to interconnect panels 11 and 12. In FIG. 2A, conventional details of the facing edges of the adjacent panels which are known in the art, such as mating astragals for sound barrier properties, are not shown for purposes of illustration but may be used with the shown hinge. Consequently, invisible hinge 20 is simply shown mounted to a planer leading edge 26 of panel 11 and a planer trailing edge 27 of panel 12.

The particular configuration of the invisible hinge 20 shown and described further herein is illustrative and not intended to be limiting, as differently configured hinges that are designed so as to be concealed within the space between the opposite room-forming facades of the panels when the panels are extended may be employed within the scope of the invention.

Figure 3:
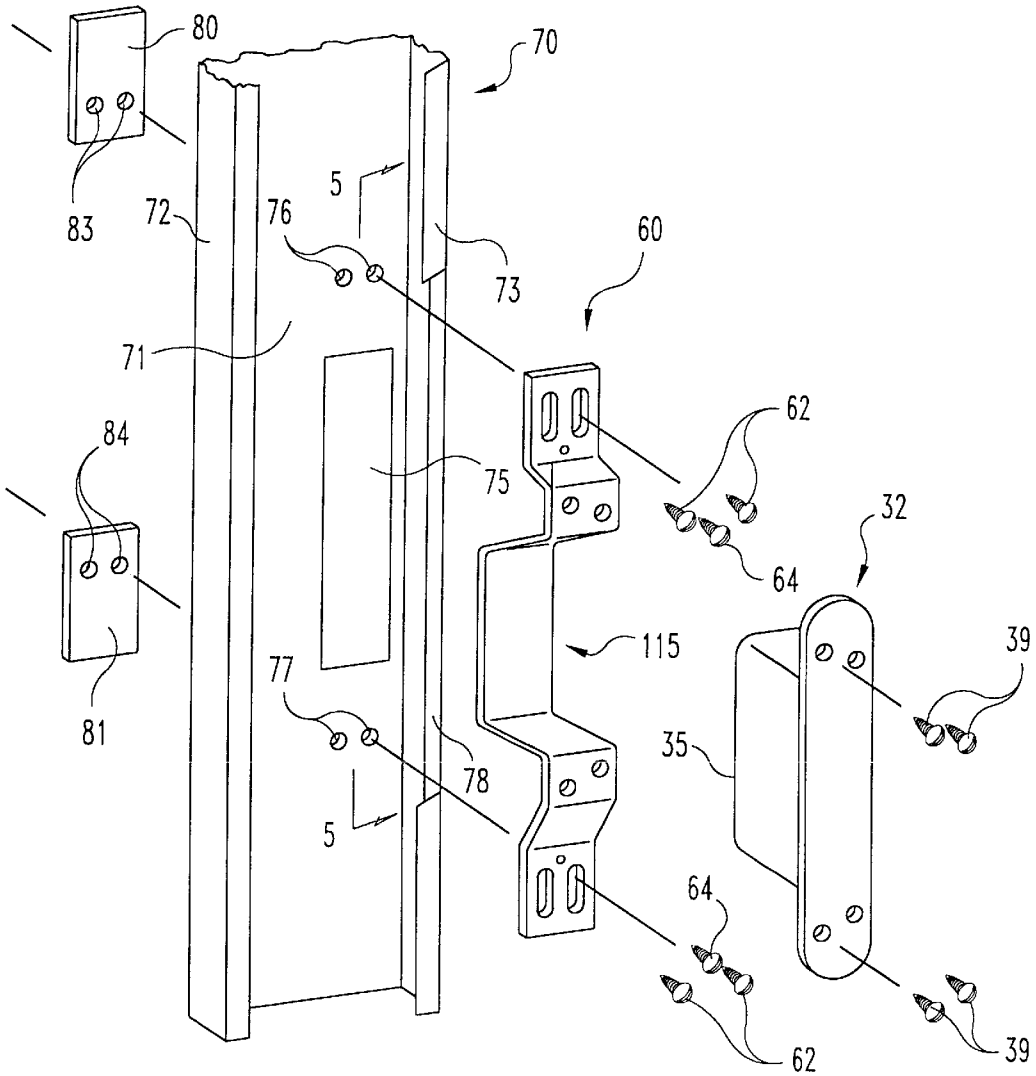
FIG. 3 is a exploded perspective view of the assembly, including one form of the inventive hinge mounting apparatus, used to mount an abstractly shown invisible hinge to the partially shown frame of the operable wall panel.

Hinge 20 is formed of interconnected hinge sections, generally designated 32 and 34, which are installed in panels 11 and 12, respectively. Hinge section 32 includes a main body 35 made of a rigid material, such as cast zinc, and to which the spanning links are operatively attached as described below. Main body 35 is inserted into the panel interior relative to panel edge 26 and therefore is shown in FIG. 2A in dashed lines. Integrally formed with main body 35 and projecting upwardly and downwardly therefrom are mounting flanges 37, 38. A vertically staggered pair of countersunk bores 36 are provided through each of flanges 37 and 38 that can accommodate screws 39 that secure hinge 20 to the inventive mounting apparatus 60 as shown in FIG. 3. Hinge section 34 similarly includes main body 40 with mounting flanges 42, 43 also with countersunk bores 45 that receive screws 39.

Figure 2B:
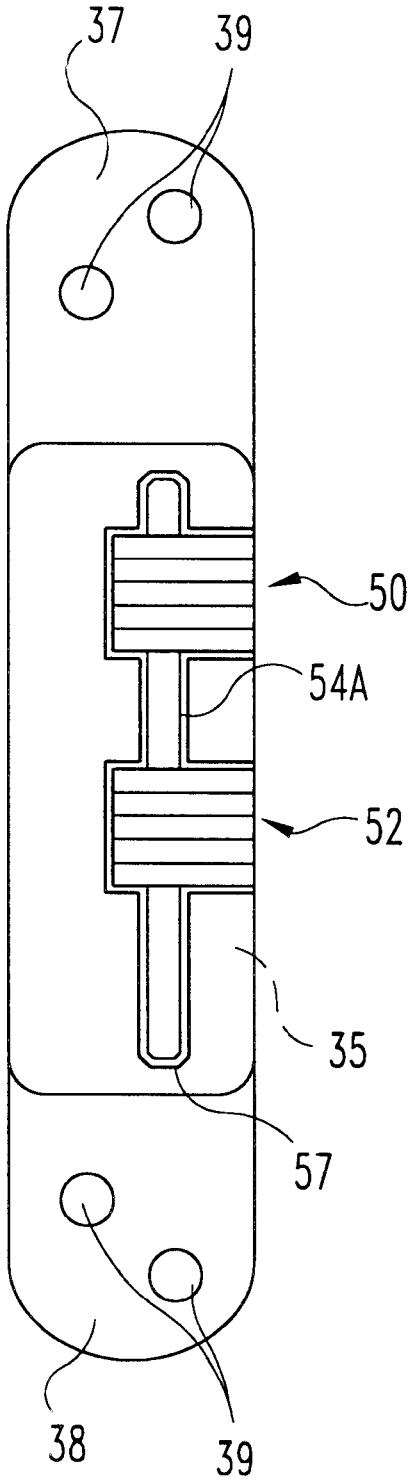
FIG. 2B is an end view of the left body portion of the hinge of FIG. 2A.

Hinge sections 32 and 34 are spanned by links 50, 51, 52 and 53. Each of links 50-53 is shown as being formed of five similarly shaped, vertically stacked linking plates. As described with reference to link 50, but as are similarly present in each of the other links 51–53, the middle three plates 50*b*, 50*c* and 50*d* are made of a high strength material, such as steel. These middle plates are vertically flanked by lubricating plates 50*a* and 50*e* made of low-friction material so as to reduce the wear and the resistance to motion of the links. From the perspective of a FIG. 2A viewer, the left end of links 50 and 52 are connected to a channel pin 54A that is captured and slides within a channel 57, shown most clearly in FIG. 2B, formed in main body 35. The right ends of links 50 and 52 are pivotally connected to a vertically extending pin 55A, shown in ghost outline, fixed to hinge main body 40. In a similar fashion, links 51 and 53 include left ends which are pivotally connected to a pin 55A, shown in ghost outline, fixed to hinge body 35, and right ends that are connected to a channel pin 54B slidable in a channel in main body 40 identical to that of main body 35 shown in FIG. 2B. Rivet pin 56, which is preferably formed of steel, vertically extends through links 50–53 thereby connecting the hinge sections.

While hinge sections 32, 34 and the spanning links 50–53 are visible when panels 11 and 12 are partially folded as shown in FIGS. 1 and 2A, when panels 11 and 12 are moved to a wall forming, extended arrangement, hinge sections 32, 34 and spanning links 50–53 are fully disposed within the space between the panel side facades 29, 30. As a result, provided the hinge sections are installed such that the facing edges of the adjacent panels abut, or provided sealing members that span the gap between the non-abutting panel edges are disposed laterally of each hinge section, no portion of hinge 20 is visible on either side of the wall formed by panels 11 and 12.

Hinges of the above-described type are known as Soss* invisible hinges and are available from Universal Industrial Products Company of Pioneer, Ohio. The available model suitable for the shown operable wall is known as the No. 220 heavy duty application hinge product, but different models may be employed with different operable walls within the scope of the present invention.

Referring now to FIG. 3, there is shown an exploded view of the assembly utilized to mount hinge 20 to panel 11. A similar assembly will naturally be used to mount the other portion of hinge 20 to panel 12. In FIG. 3, hinge section 32 is abstractly shown to facilitate illustration and is attachable with screws 39 to a hinge mounting apparatus, which is shown as being provided in the form of a one-piece bracket, generally designated 60. Other shapes of the hinge mounting apparatus may also be used within the scope of the present invention. Bracket 60 is attachable with screws 62, and lockable with screws 64 as described further below, to an internal vertical frame member, generally designated 70, of panel 11.

Frame member 70 is fixedly attached to horizontal frame members of the panel at its top and bottom ends to form part of the rectangular framework upon which panel 11 is assembled. Vertical frame member 70, which may be otherwise shaped, is made of a steel channel having a base plate 71 with lipped edges 72 and 73. To accommodate bracket 60 and hinge 20, frame member base plate 71 includes a rectangular opening 75 and a first pair of holes 76 vertically spaced from one end of opening 75 and a second pair of holes 77 vertically spaced from the opposite end of opening 75. Lipped edge 73 is notched at 78 to allow positioning of hinge 20 closer to the panel facade.

Backing plates 80 and 81 are each preferably made of a 3⁄16 inch thick steel plate and include a pair of holes 83 and 84, respectively. Backing plates 80, 81 are rigidly attached to the back of base plate 71, for example by spot welding, such that holes 83 and 84 align with holes 76 and 77, respectively, of frame member 70. While each of backing plate 80 and 81 is shown with two holes, additional holes can be provided, for example in situations where such additional holes are used to hold the backing plate in place while it is spot-welded, or where such additional holes receive fasteners that fasten the backing plate to the vertical frame member. In configurations where the frame member 70 is of sufficient rigidity and strength, backing plates 80 and 81 may be eliminated.

Figure 4:
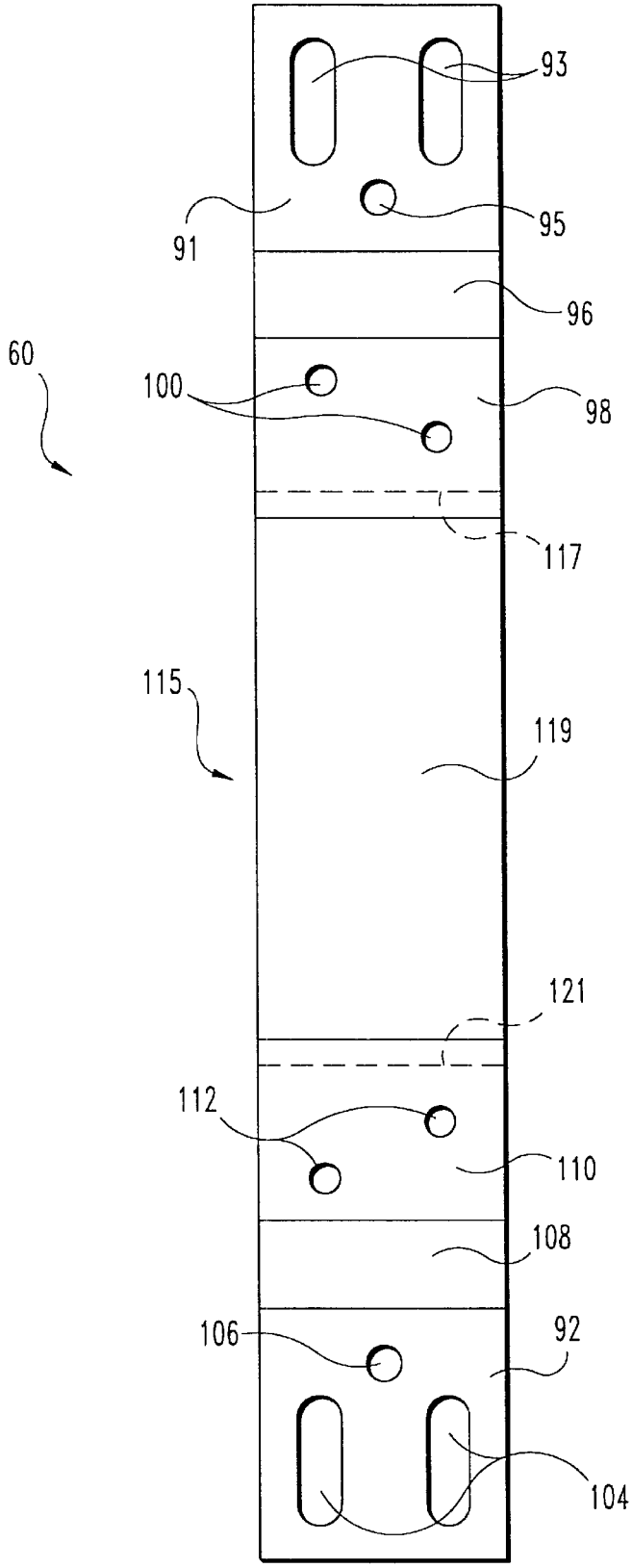
FIG. 4 is an end view of the hinge mounting apparatus of FIG. 3.

With additional reference to the end view of bracket 60 shown in FIG. 4, bracket 60 is preferably formed in one piece from a 1⅜ inch wide and ⅛ inch thick steel strip. Bracket 60 includes planar installation flanges 91 and 92 at its opposite ends. Installation flange 91 includes a pair of vertically extending slots 93 and a circular aperture 95 used in the locking of the bracket. Although pairs of slots are shown at each bracket end, a single slot on each end could be utilized on the bracket to provide mounting with vertical adjustability, In addition, in situations where vertical adjustability of the hinge is not desired, the slots with screws can be replaced with other forms of attachment of the bracket to the frame.

Installation flange 91 is integrally formed with an offsetting span 96, angled at 45° from flange 91, which leads to a planar hinge mounting section 98 provided with a pair of staggered holes 100 therethrough. Bracket 60 can be manufactured such that hinge mounting section 98 is a desired offset from flange 91 to account for the depth which the frame member 70 is spaced from the panel side edge 26. Installation flange 92 includes slots 104, locking aperture 106, and is integrally formed with an angled offsetting span 108 integrally formed with hinge mounting section 110 provided with holes 112.

Hinge mounting sections 98 and 110 flank and are integrally formed with a sound baffling, C-shaped plate section, generally designated 115. C-shaped plate section 115 is formed by an upper end wall 117, a solid lower end wall 121, and a solid bottom or inward wall 119 that spans walls 117 and 121. As shown in the cross-sectional view of FIG. 5, wherein hinge section 32 is shown in dashed lines mounted to bracket 60, sound baffling plate section 115 covers the upper face 35*a*, lower face 35*c*, and the inward, inserted face 35*b* of main body 35 to limit sound transmission. Plate section walls 117, 119 and 121 are at least as wide, and preferably substantially the same width, as the width of the inserted main body 35. Plate section 115 is custom sized and configured to closely conform to hinge main body 35, such as with gaps therebetween being within a range of 1⁄32 inch and ⅛ inch, and preferably no more than about ⅛ inch.

To install hinge 20 to frame member 70 and thereby panel 11, hinge section 32 is attached to mounting bracket 60 with self-tapping screws 39 that insert through the holes in mounting flanges 37 and 38 and which threadedly engage hinge mounting sections 98 and 110 within holes 100 and 112. Mounting bracket 60 is attached to the panel frame by aligning slots 93 and 104 with holes 76 and 77, respectively, in the frame, and inserting screws 62 through such slots and into threaded engagement with frame body 71 and backing plates 80, 81 within holes 76, 77, 83 and 84. Because slots 93 and 104 are designed with a length larger than the diameter of screws 62, and provided screws 62 are not fully tightened down, bracket 60 can be moved up and down with screws 62 effectively moving within the slots until the proper height of the hinge is obtained.

When the hinge and bracket is properly located, such that, for example, the facades of panels 11 and 12 are appropriately lined up after installation, after screws 62 are tightened, self-tapping locking screws 64 are inserted through holes 95 and 106 and bore into frame body 71 and backing plates 80 and 81 in order to lock the bracket in place vertically. While two locking screws 64 or other type fasteners are preferred, a single locking member may be inserted through the locking hole of a single one of the installation flanges in order to secure the bracket. When installed, the mounting assembly of FIG. 3 is arranged as shown in the cross-sectional view of FIG. 5, wherein the hinge section 32 and the panel edge 26 are both shown in dashed lines.

Although not shown, in order to control the depth to which hinge 20 is mounted relative to the frame, rigid shims, such as in the form of metal plates with holes to accommodate the fasteners 62 and 64, are preferably installed between the inward faces of installation flanges 91, 92 and the outward surface of frame body 71 prior to the use of screws 62 and 64 to mount and then lock bracket 60 to frame 70.

Figure 5:
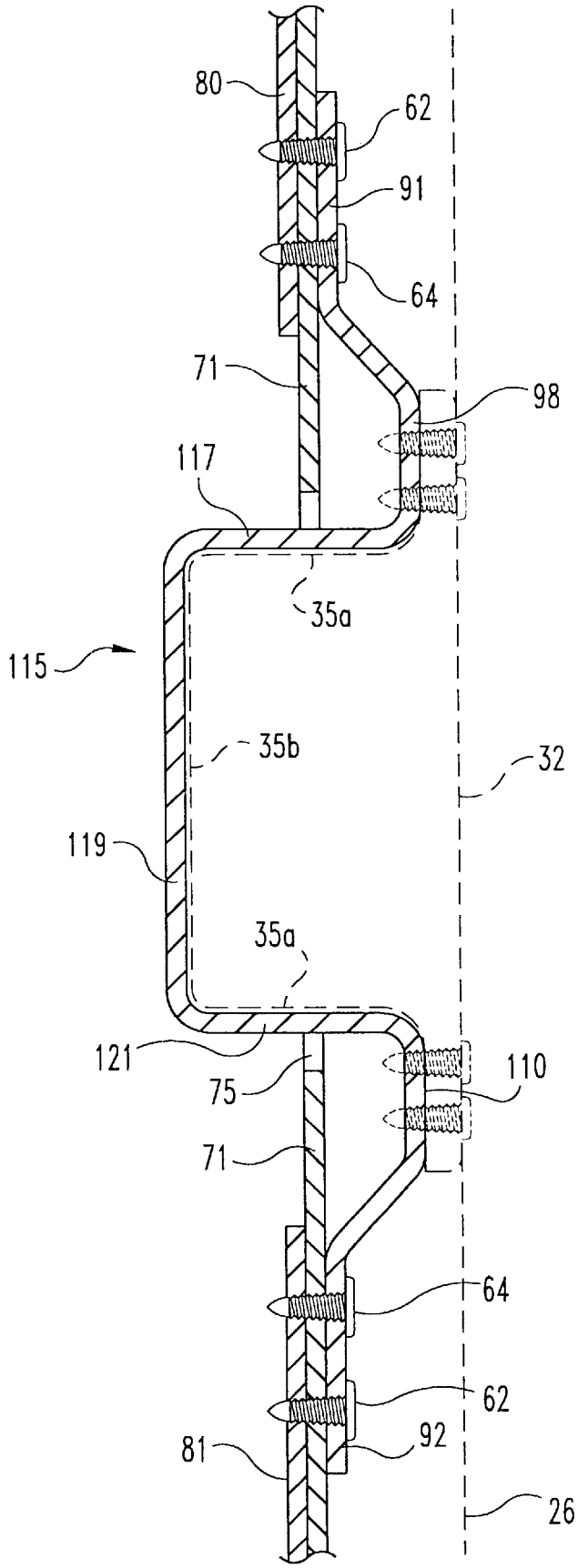
FIG. 5 is a cross-sectional side view, conceptually taken along the line 5—5 of FIG. 3, of the hinge mounting apparatus of FIG. 4 after its connection to the panel frame.
Figure 6:
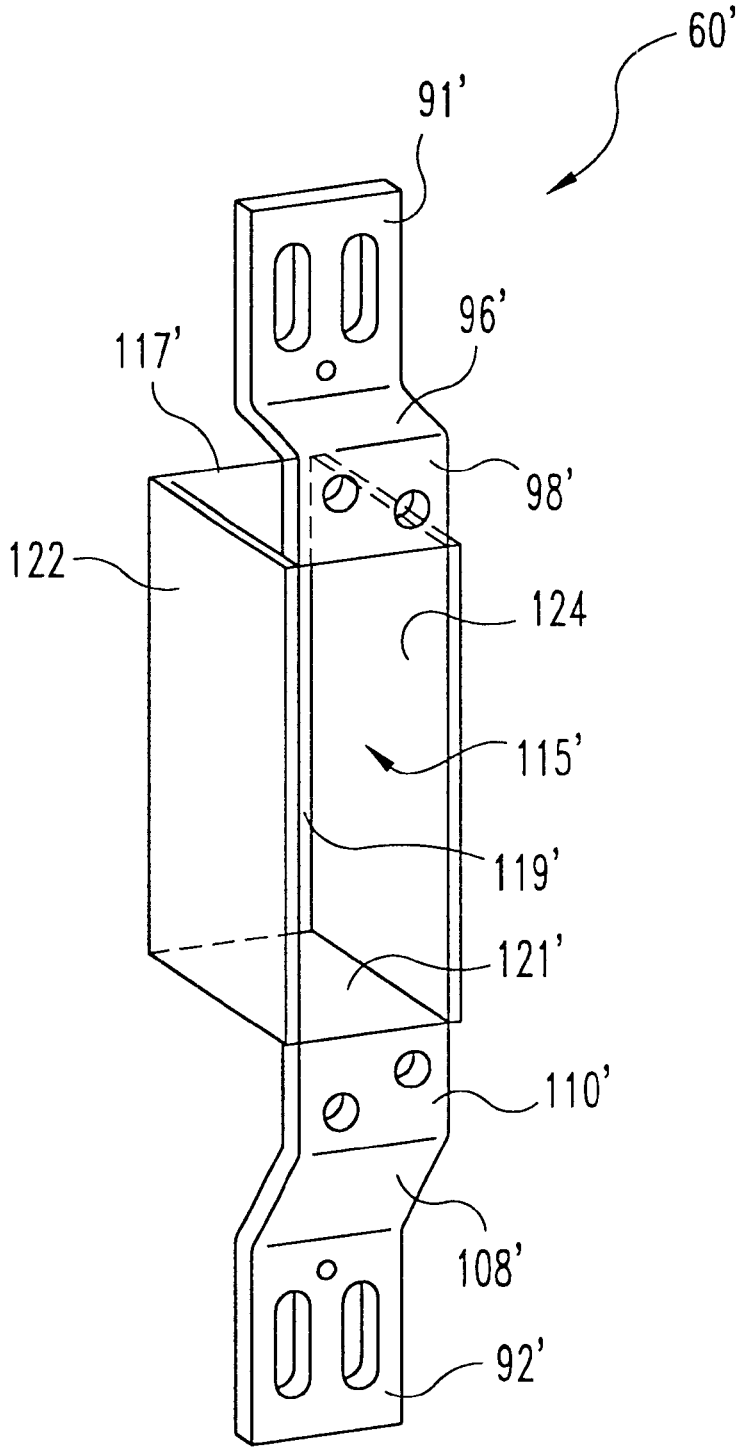
FIG. 6 is a perspective view of an alternate embodiment of a hinge mounting apparatus of the present invention.
Figure 7:
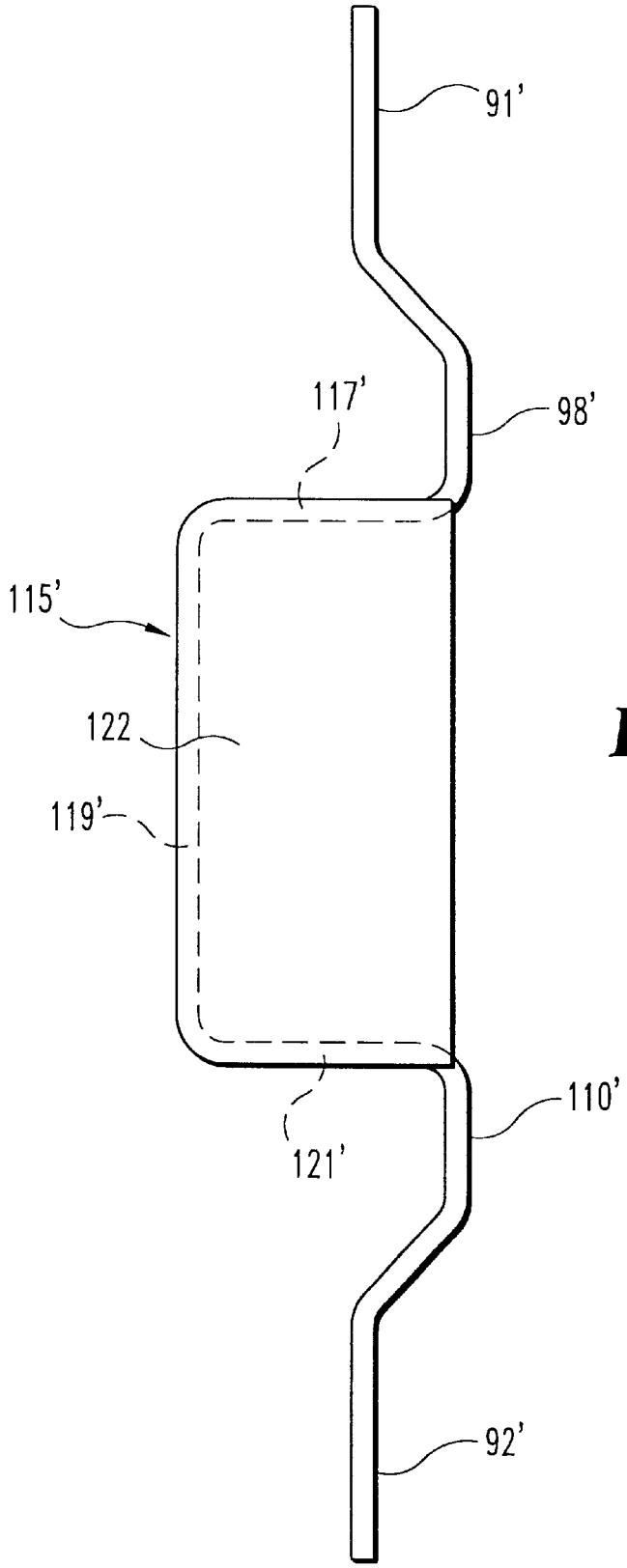
FIG. 7 is a side view of the hinge mounting apparatus of FIG. 6.

Referring now to FIGS. 6 and 7, there is shown an alternate embodiment of a hinge mounting apparatus of the present invention. In this embodiment, hinge mounting apparatus or bracket 60' is substantially similarly formed to mounting bracket 60 of FIGS. 3–5, and therefore corresponding parts are referenced with a prime notation and not further described herein.

Unlike bracket 60, bracket 60' includes solid, rectangular plates 122 and 124 which flank plate section 115' and cooperate therewith to form a generally enclosed volume. In a preferred method of manufacture, bracket 60' is stamped and then bent from a single plate, and flanking plates 122 and 124 are initially formed as lateral extensions of bottom wall 119' that are bent along their intersection with bottom wall 119' to the positions shown in FIG. 6, and then welded along the entire height of their intersections with lower and upper end walls 117' and 121'. The parallelepiped volume thereby formed is airtight but for the opened area through which the hinge is inserted into that volume, and plate section 115' and plates 122 and 124 enclose the insert face and four sides of main body 35 of hinge section 32 to provide a sound barrier for the hinge.

Figure 8:
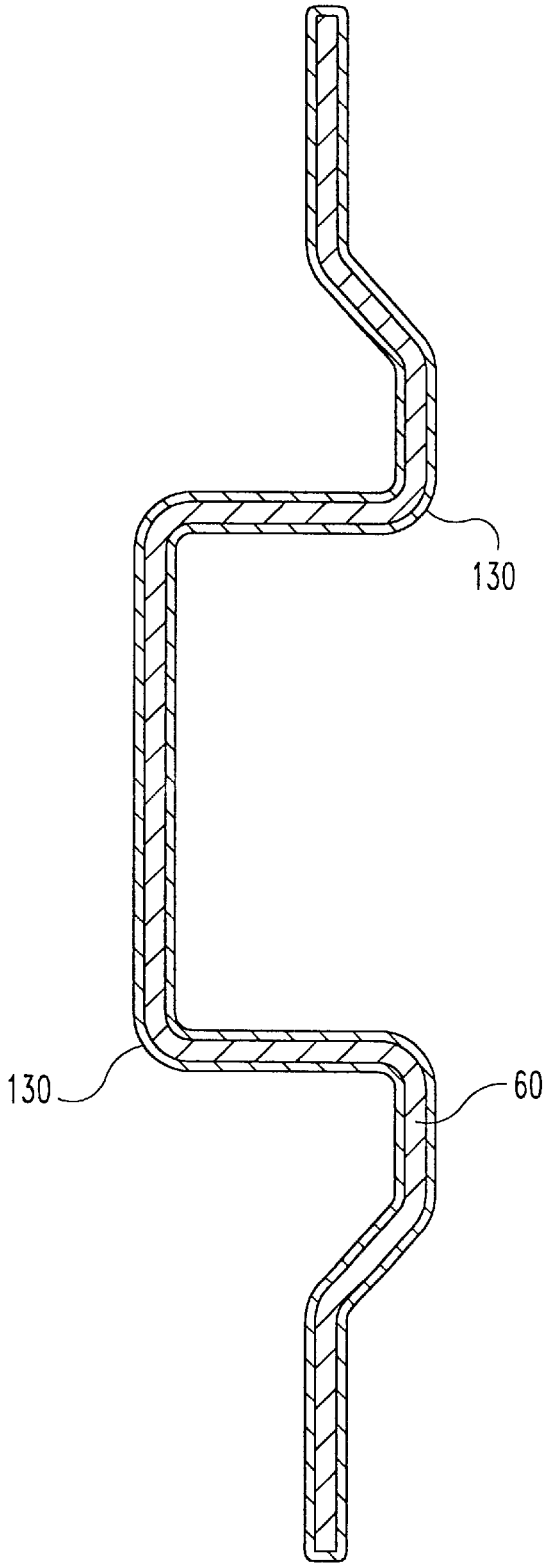
FIG. 8 is a cross-sectional side view of still another alternate embodiment of a hinge mounting apparatus of the present invention.

Referring now to FIG. 8, there is shown another alternate embodiment of a mounting bracket of the present invention. In this embodiment, in order to further dampen vibrations and transmission of sound, the entire periphery of bracket 60 from FIGS. 3–5 is provided with a coating 130. One suitable coating, which may be applied in a dipping or spraying process, is made of latex and has a uniform thickness within the range of about 1/32 inch and 1/16 inch, and preferably is about 1/16 inch. Other coating materials may also be used. Not all of the bracket needs to be coated within the scope of the invention. For example, when an acoustic boot described below is used, the plate section 115 of the bracket need not be covered.

Figure 9:
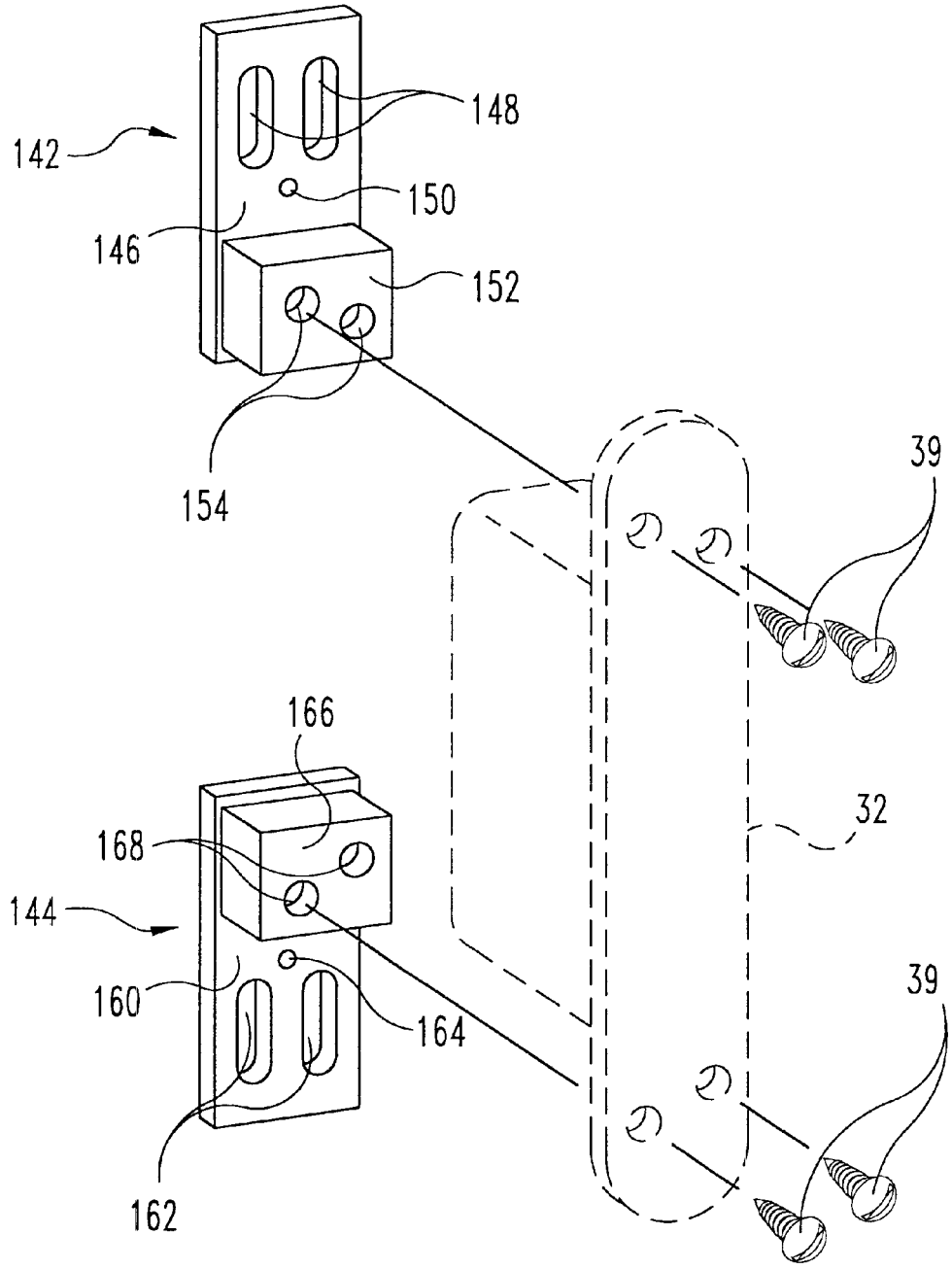
FIG. 9 is a perspective view of still another alternate embodiment of a hinge mounting apparatus of the present invention for use with the invisible hinge abstractly shown in dashed lines.

Referring now to FIG. 9, there is shown still another embodiment of a hinge mounting apparatus of the present invention. The mounting apparatus is provided in the form of bracket portions 142 and 144 that are mounted to opposite ends of the abstractly shown hinge section 32 with screws 39. Bracket portion 142 is formed of a steel base plate 146 including slots 148 and a locking aperture 150 which accommodate not shown fasteners to allow the fastening and locking of bracket portion 142 to the not shown panel frame. Steel block 152 is attached by welding to the lower region of bracket base plate 146, and includes screw-receiving bores 154 to mount the hinge. Bracket portion 144 similarly includes base plate 160, slots 162, locking aperture 164, and block 166 with bores 168. The thickness of blocks 152 and 166 is selected based on the offset needed between the frame and the hinge.

Figure 10:
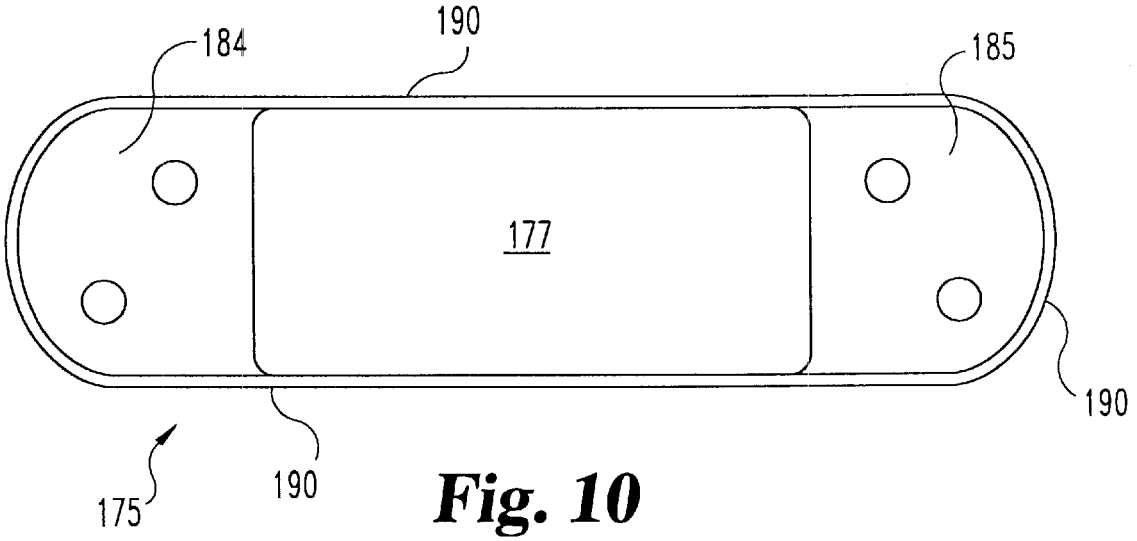
FIG. 10 is a top view of a first embodiment of an acoustical boot of the present invention.
Figure 11:
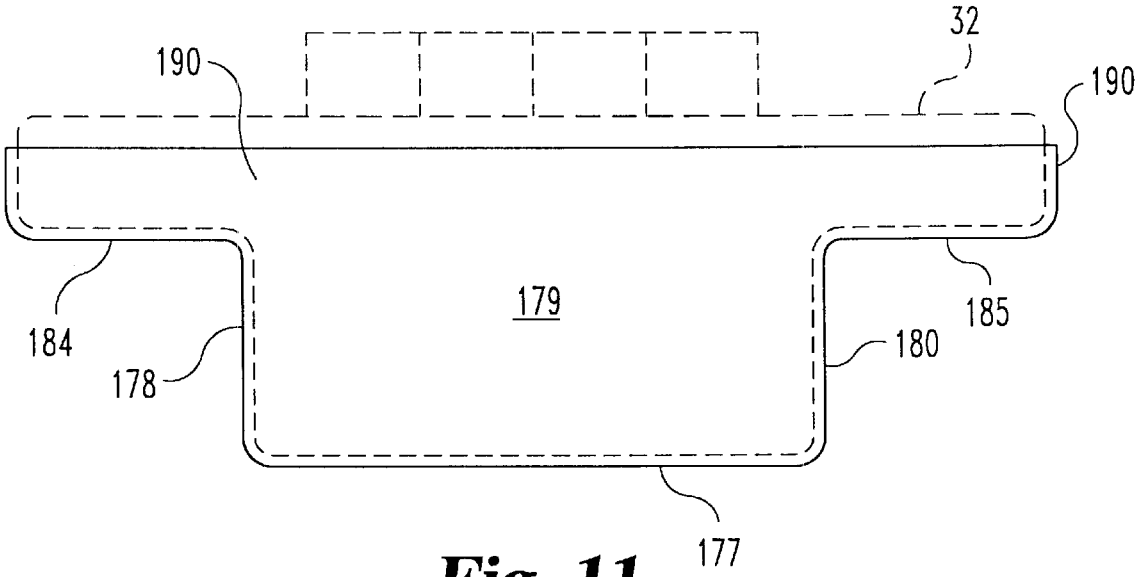
FIG. 11 is a side view of the acoustical boot of FIG. 10, wherein the invisible hinge section inserted therein is abstractly shown in dashed lines.

Referring now to FIGS. 10 and 11, there is shown an acoustical boot, generally designated 175, of the present invention. Acoustical boot 175 has a one-piece molded construction and encases at least substantially all of the hinge body 35, as well as portions of mounting flange 37, 38 of invisible hinge 20. Boot 175 includes a base 177 that covers the inward face of body 35, and side and end portions 178–181 that cover the four faces of body 35. Shoulder portions 184, 185 extend from end portions 178 and 180, and lip 190 rings the shoulder portions and upper extremes of the side portions 179 and 181. When hinge section 32 is inserted into the boot 175 as shown in dashed lines in FIG. 11, due to the apertureless construction of boot 175 other than the holes for the hinge mounting screws, sound barrier characteristics of the hinge are improved. Boot 175 is made of a pliable material such as vinyl, or other types of extrudable materials may be employed. A suitable thickness of the material of boot 175 is within the range of 1/64 inch and 1/16 inch, and is preferably about 1/32 inch. Boot 175 may be installed on hinge section 32 and used in conjunction with any of the brackets disclosed herein.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

For example, vertical adjustability of the bracket relative to the frame can be provided by using slots in the frame members and backing plates, and then securing a slot-less bracket to the slotted frame and then locking the bracket in place with one or more screws 64. This application is therefore intended to cover any variations, uses, or adaptations of the invention using its general principles. Further, this application is intended to cover such departures from the present disclosure as come within known or customary practice in the art to which this invention pertains.

What is claimed is:

1. A mounting apparatus for an invisible hinge comprising: a bracket, including, opposite first and second vertically displaced ends, each said first and second end including a portion defining at least one vertically arranged slot to allow vertical adjustment of said bracket on an edge frame of an operable wall, and a recessed plate portion, recessed into said edge frame, and interconnecting said opposite first and second ends, said plate portion adapted to receive a main body portion of the invisible hinge, wherein each said first and second ends further includes, a hinge mounting section connected to said recessed plate portion and defining at least one hinge mounting hole for attachment of a flange of the invisible hinge to said edge frame of said operable wall, and an offsetting span connecting said hinge mounting section to said slot defining portion, said offsetting span projecting vertically from said hinge mounting section and angled so that said slot defining portion is recessed relative to said hinge mounting section.

2. The mounting apparatus of claim 1 wherein at least one of said slot defining portions defines at least one locking hole configured to receive a fastener to lock said bracket in position on said edge frame after adjustment.

3. The mounting apparatus of claim 1 wherein said recessed plate portion includes first and second end walls each connected to a respective hinge mounting section, and an inward wall spanning said first and second end walls forming a receptacle to receive a main body portion of the invisible hinge.

4. The mounting apparatus of claim 3 wherein said bracket is integrally formed.

5. The mounting bracket of claim 3 wherein said bracket is made of steel.

6. The mounting apparatus of claim 3 wherein said bracket is covered with a sound absorbing coating.

7. The mounting apparatus of claim 6 wherein said coating is latex.

8. The mounting apparatus of claim 3 wherein said recessed plate portion further includes a pair of side plates, attached one to each side of said recessed plate portion to-form a box to receive a main body portion of the invisible hinge.

9. The mounting apparatus of claim 3 wherein said recessed plate portion includes a boot receivable in said recessed plate portion and sized to receive a main body portion of an invisible hinge.

10. The mounting apparatus of claim 9 wherein said boot is made of a pliable material.

11. The mounting apparatus of claim 10 wherein said pliable material is vinyl.

12. The mounting apparatus of claim 1 further including a backing plate locatable behind each said first and second end portions to mount said bracket to said edge frame.

13. The mounting apparatus of claim 1 wherein said offsetting spans are angled at about 45 degrees relative to said first and second end portions.

14. The mounting apparatus of claim 1 wherein said recessed plate portion includes first and second end walls each connected to a respective hinge mounting section, and an inward wall spanning said first and second end walls forming a receptacle to receive a main body portion of the invisible hinge.

15. A mounting apparatus for an invisible hinge comprising:

first and second mounting brackets vertically spaced on an edge frame of an operable wall to span the mounting flanges of an invisible hinge, each said bracket including, a base plate defining at least one vertically arranged slot to allow vertical adjustment of said bracket on said edge frame, and a block attached to said base plate, said block having a pair of threaded holes for attachment of an invisible hinge.

16. The mounting apparatus of claim 15 wherein at least one of said first and second brackets defines at least one locking hole to receive a fastener to lock said bracket in position on said edge frame after adjustment.

17. An operable wall panel assembly for partitioning a room, said wall panel assembly comprising:

at least one wall panel having an edge frame;

an invisible hinge connecting said at least one panel to an adjacent panel; and a mounting bracket for mounting said invisible hinge to said edge frame of said at least one wall panel, said bracket including, opposite first and second vertically displaced ends, each said first and second end including a portion defining at least one vertically arranged slot to allow adjustment vertical adjustment of said bracket on an edge frame of an operable wall, and a recessed plate portion, recessed into said edge frame, and interconnecting said opposite first and second ends, said plate portion adapted to receive a main body portion of the invisible hinge, wherein each said first and second ends further includes, a hinge mounting section connected to said recessed plate portion and defining at least one hinge mounting hole for attachment of a flange of the invisible hinge to said edge frame of said operable wall, and an offsetting span connecting said hinge mounting section to said slot defining portion, said offsetting span projecting vertically from said hinge mounting section and angled so that said slot defining portion is recessed relative to said hinge mounting section.

18. The mounting apparatus of claim 17 wherein at least one of said slot defining portions defines at least one locking hole configured to receive a fastener to lock said bracket in position on said edge frame after adjustment.

* * * * *